US006969280B2

(12) United States Patent
Chien et al.

(10) Patent No.: US 6,969,280 B2
(45) Date of Patent: Nov. 29, 2005

(54) ELECTRICAL CONNECTOR WITH DOUBLE MATING INTERFACES FOR ELECTRONIC COMPONENTS

(75) Inventors: Chih-Ming C Chien, Tu-chen (TW); Yi-Wen Wang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/889,848

(22) Filed: Jul. 12, 2004

(65) Prior Publication Data

US 2005/0009402 A1 Jan. 13, 2005

(30) Foreign Application Priority Data

Jul. 11, 2003 (TW) ..... 92212809 U

(51) Int. Cl.[7] ..... H01R 13/648
(52) U.S. Cl. ..... 439/608; 439/607
(58) Field of Search ..... 439/607–608, 439/541.5, 108

(56) References Cited

U.S. PATENT DOCUMENTS 6,109,968 A * 8/2000 Wang ..... 439/607
6,155,872 A * 12/2000 Wu ..... 439/541.5
6,478,622 B1 11/2002 Hwang ..... 439/607
6,517,382 B2 2/2003 Flickinger et al. ..... 439/607
6,524,134 B2 2/2003 Flickinger et al. ..... 439/607
6,607,401 B1 * 8/2003 Weaver et al. ..... 439/608
6,712,646 B2 * 3/2004 Shindo ..... 439/608
6,764,349 B2 * 7/2004 Provencher et al. ..... 439/701
6,773,305 B2 * 8/2004 Wu ..... 439/608
6,776,659 B1 * 8/2004 Stokoe et al. ..... 439/608
2004/0224559 A1 * 11/2004 Nelson et al. ..... 439/608
2005/0048842 A1 * 3/2005 Benham et al. ..... 439/608

* cited by examiner

*Primary Examiner*—Michael C. Zarroli
(74) *Attorney, Agent, or Firm*—Wei Te Chung

(57) ABSTRACT

An electrical connector (1) includes an insulative housing (3) mounted onto a mother board, and a mulitiplicity of contact modules (7) received in the housing. The housing defines first and second openings (245, 246) in a front portion thereof. Each contact module includes first, second, third and fourth contacts (80, 82, 86, 88) and a ground contact (84). The first and second contacts are inserted into the first opening to form a first signal contact group, thereby providing a first mating interface for a daugher board. The third and fourth contacts are inserted into the second opening to form a second signal contact group, thereby providing a second mating interface for another daughter board. The ground contacts are disposed betweent the first and second signal contact groups. The connector can thereby electrically connect the daughter boards with the mother board simultaneously.

13 Claims, 7 Drawing Sheets

ELECTRICAL CONNECTOR WITH DOUBLE MATING INTERFACES FOR ELECTRONIC COMPONENTS

BACKGROUND OF THE INVENTION

1. Field of the Invention

The present invention relates to the art of electrical connectors, and particularly to electrical connectors used in small form-factor pluggable (SFP) transceivers that provide bi-directional transmissions of data between electrical interfaces and optical data links for networking applications, wherein the connectors are generally used for receiving electronic components such as daughter boards and electrically connecting said electronic components with circuit substrates such as mother boards.

2. Description of the Prior Art

Various international and industry standards define transceivers that provide bi-directional transmissions of data between electrical interfaces and optical data links for networking applications. One type of transceiver developed by an industry consortium is known as the small form-factor pluggable (SFP) transceiver. A correlative article is found in *Taking the NETWORK to the Next Level* (Connector Specifier, February 2002). Pertinent examples of such transceivers are also disclosed in U.S. Pat. Nos. 6,524,134, 6,517,382, and 6,478,622. Normally, the transceiver is mounted on a mother board of a piece of host equipment such as a network switch, a router, a server or a storage device. The transceiver can receive electrically encoded data signals, and convert them into optical signals which are then transmitted over the optical data link. The transceiver also can receive optically encoded data signals, convert them into electrical signals, and transmit the electrical signals to an electrical interface.

Generally, a transceiver includes a parallelepiped-shaped metallic shielding cage. A receptacle is mounted in a front portion of the cage for providing a mating interface for a transceiver module. A daughter board is mounted to a rear of the receptacle, and extends rearward in the cage. An electrical connector is mounted in a rear portion of the cage, for receiving a rear portion of the daughter board. The connector comprises an insulative housing, and a plurality of electrical contacts received in the housing. The contacts are exposed out of the cage and electrically connected to a mother board. The connector thus electrically connects the daughter board with the mother board. The daughter board can convert electrically encoded data signals into optical signals. The daughter board can also convert optically encoded data signals into electrical signals.

However, in the above-mentioned transceiver, the contacts are electrically connected with the mother board by surface mount technology (SMT) or through hole (TH) technology. This increases the difficulty of assembling/disassembling the transceiver to/from the mother board. The contacts are insert-molded in the housing. If one of the contacts is damaged, the connector must be disassembled from the mother board and discarded. This increases the costs of using and maintaining the transceiver.

Additionally, with ongoing developments in the electronics industry, requirements for transmission performance of transceivers are becoming more demanding. It is now commonly required that the transceiver has two or more mating interfaces to receive a plurality of transceiver modules simultaneously. Therefore, an electrical connector used in the transceiver needs to electrically connect a plurality of daughter boards with a mother board simultaneously.

In view of the above, a new electrical connector used in a transceiver which overcomes the above-mentioned disadvantages is desired.

SUMMARY OF THE INVENTION

Accordingly, a main object of the present invention is to provide an electrical connector used in a transceiver that provides bi-directional transmission of data between an electrical interface and an optical data link, wherein the connector is configured to receive a plurality of electronic components such as daughter boards and electrically connect said electronic components with a circuit substrate such as a mother board.

Another object of the present invention is to provide an electrical connector having a plurality of contact modules, any one or more of which can be readily removed from the connector and replaced by a substitute without damaging the connector.

A further object of the present invention is to provide an electrical connector, which can be readily mounted/disassembled to/from a circuit substrate such as a mother board.

To achieve the above-mentioned objects, an electrical connector in accordance with a preferred embodiment of the present invention is used in a transceiver. The connector comprises an insulative housing mounted onto a mother board, and a plurality of contact modules. The housing defines first and second opening in a front portion thereof. Each contact module comprises first, second, third and fourth electrical contacts and a ground contact. The contact modules are received in the housing. The first and second contacts are inserted into the first opening to form a first signal contact group, thereby providing a first mating interface for a daughter board. The third and fourth contacts are inserted into the second opening to form a second signal contact group, thereby providing a second mating interface for another daughter board. The ground contacts are disposed betweent the first and second signal contact groups. The connector can thereby receive two daughter boards simultaneously and electrically connect the daughter boards with the mother board.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
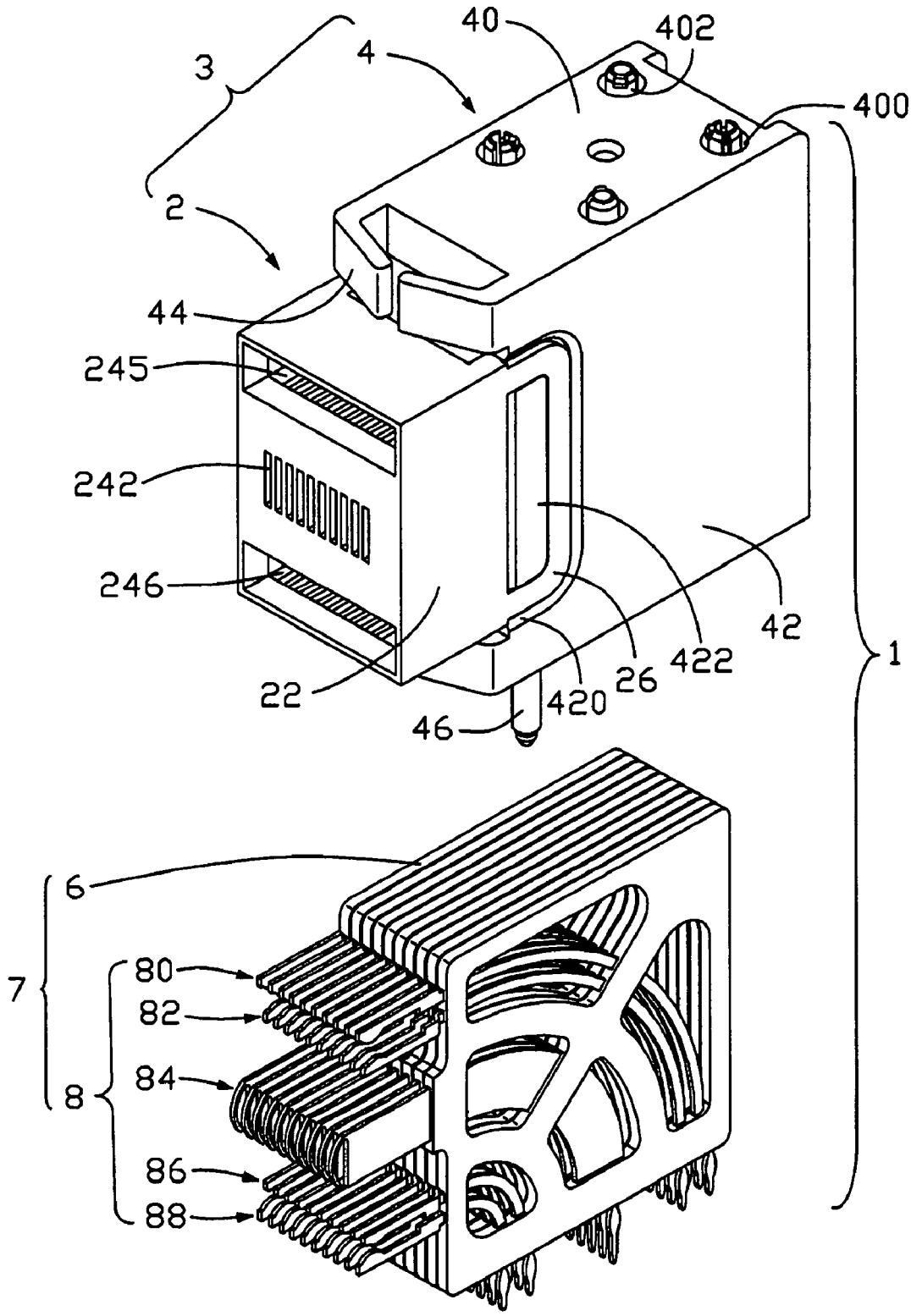
FIG. 1 is an exploded, isometric view of an electrical connector in accordance with the preferred embodiment of the present invention, the connector comprising an insulative housing and a plurality of contact modules.

FIG. 1 is an exploded, isometric view of an electrical connector 1 in accordance with the preferred embodiment of the present invention. The connector 1 is used in a transceiver (not shown) that can provide bi-directional transmission of data between an electrical interface and an optical data link for networking applications. Generally, the transceiver includes a parallelepiped-shaped metallic shielding cage (not shown), a plurality of receptacles (not shown) stacked in a front portion of the cage for providing mating interfaces for a plurality of transceiver modules, a plurality of daughter boards (not shown) mounted at rear portions of the receptacles and extending rearward in the cage, and the connector 1 mounted in a rear portion of the cage. The daughter boards can convert electrically encoded data signals into optical signals. The daughter boards can also convert optically encoded data signals into electrical signals. The connector 1 receives rear portions of the daughter boards, and is mounted on a mother board (not shown). The connector 1 can thereby provide electrical connections between the daughter boards and the mother board.

Figure 2:
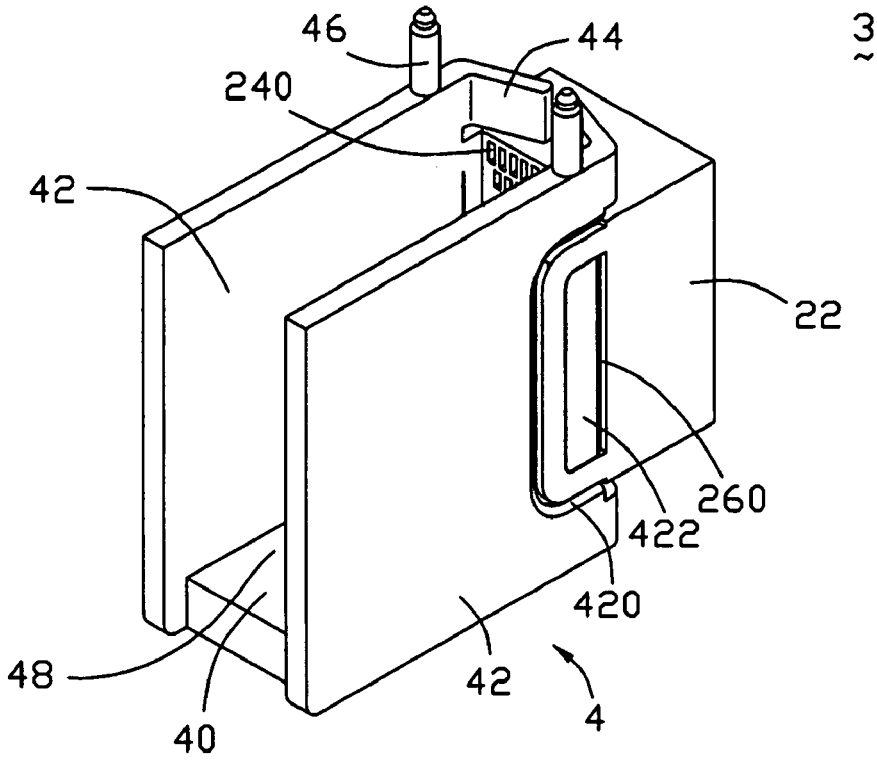
FIG. 2 is an isometric view of the housing of FIG. 1, but showing the housing inverted.

The connector 1 comprises an insulative housing 3, and a plurality of contact modules 7 received in the housing 3. In the preferred embodiment of the present invention, ten contact modules 7 are provided. FIG. 2 is an isometric view of the housing 3 inverted. The housing 3 comprises a base portion 4, and a head portion 2 mounted on a front portion of the base portion 4.

The base portion 4 has a generally U-shaped configuration, and comprises a pair of parallel lateral walls 42 and a top wall 40 interconnecting top edges of the lateral walls 42. A generally rectangular receiving cavity 48 is thereby defined between the lateral walls 42 and the top wall 40. Two holes 400 are defined in each of opposite lateral side portions of the top wall 40. A bifurcated post 402 extends upwardly from the top wall 40 in each hole 400. An end of the post 402 protrudes above the top wall 40. The posts 402 are for engaging in bores of the cage of the transceiver, and thereby attaching the connector 1 to the cage. Each lateral wall 42 defines a recess 420 in a middle of a front portion thereof. A wedge 422 is formed at the front poriton of each lateral wall 42 in the recess 420. A pair of wings 44 is formed at opposite top and bottom ends respectively of the front portion of each lateral wall 42. The wings 44 at the top ends of the lateral walls 42 extend obliquely forwardly and generally toward each other. The wings 44 at the bottom ends of the lateral walls 42 extend obliquely forwardly and generally toward each other. A columned positioning post 46 is formed at a bottom of the lateral wall 42, for engaging with the mother board.

Figure 3:
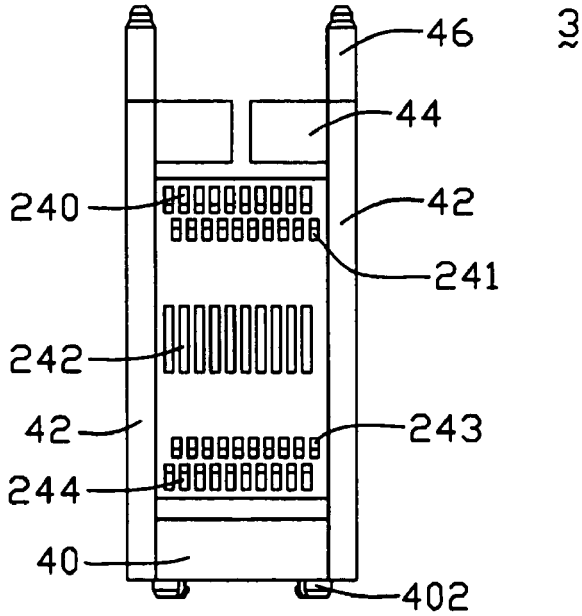
FIG. 3 is a rear elevation of the housing of FIG. 2.

The head portion 2 has a generally rectangular configuration, and comprises a body 22 and a pair of ears 26 extending rearward from two opposite lateral sides of the body 22 respectively. The body 22 defines generally rectangular first and second openings 245, 246 in a front portion thereof. The first opening 245 is at a top of the front portion, and the second opening 246 is at a bottom of the front portion. FIG. 3 is a rear elevation of the inverted housing 3 of FIG. 2. The body 22 also defines a row of first passageways 240, a row of second passageways 241, a row of third passageways 242, a row of fourth passageways 243, and a row of fifth passageways 244 therethrough. The first and second passageways 240, 241 are in communication with the second opening 246. The rows of first and second passageways 240, 241 are staggered relative to each other, as viewed from the rear elevation. The fourth and fifth passageways 243, 244 are in communication with the first opening 245. The rows of fourth and fifth passageways 243, 244 are staggered relative to each other, as viewed from the rear elevation. The third passageways 243 are located in a medial portion of the body 22 between the first opening 245 and second opening 246. Each ear 26 defines a generally rectangular window 260 therein. The wedges 422 of the base portion 42 engage in the windows 260 of the ear 26, thereby mounting the head portion 2 onto the base portion 4.

Each contact module 7 comprises an insulative frame 6, and a set of electrical contacts 8 received in the frame 6.

Figure 4:
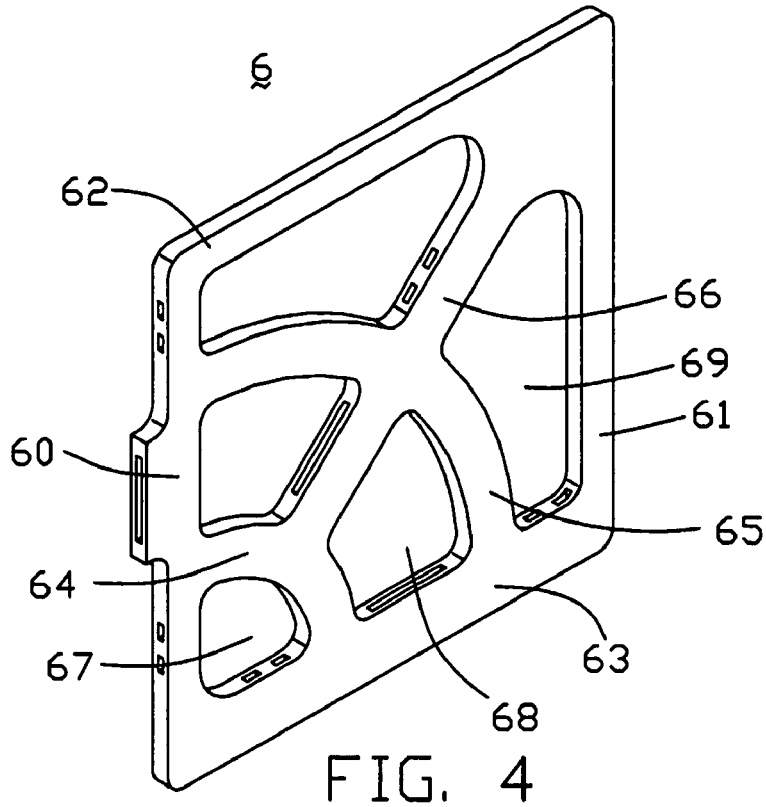
FIG. 4 is an enlarged, isometric view of a frame of one of the contact modules of FIG. 1.

FIG. 4 is an isometric view of the frame 6. The frame 6 is a generally rectangular structure, and comprises a front beam 60, a rear beam 61, a top beam 62 interconnecting top ends of the front and rear beams 60, 61, and a bottom beam 63 interconnecting bottom ends of the front and rear beams 60, 61. A small, curved first rib 64 interconnects a lower portion of the front beam 60 with a forward portion of the bottom beam 63. A first space 67 is defined by the first rib 64, the front beam 60 and the bottom beam 63. A large, curved second rib 65 interconnects an upper portion of the front beam 60 with a rearward portion of the bottom beam 63. A third rib 66 interconnects the first rib 67 with a top, rear corner of the frame 6, the third rib 66 intersecting the second rib 65. A pair of second spaces 68 is defined by the first rib 64, the front beam 60, the bottom beam 63 and the second rib 65. A pair of third spaces 69 is defined by the second rib 65, the front beam 60, the bottom beam 63, the top beam 62, and the rear beam 61.

Figure 5:
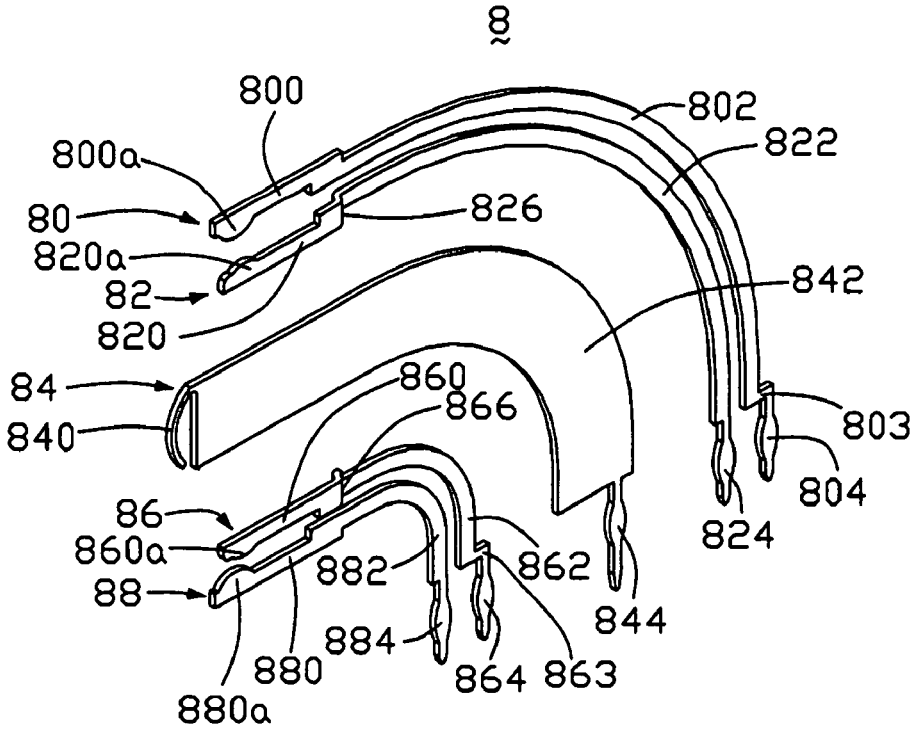
FIG. 5 is an isometric view of a set of contacts of one of the contact modules of FIG. 1.

FIG. 5 is an isometric view of the set of contacts 8. The set of contacts 8 comprises a first contact 80, a second contact 82, a ground contact 84, a third contact 86 and a fourth contact 88, each being formed from a metallic sheet. The first contact 80 comprises a curved first engaging portion 802, a first contact portion 800 extending from an end of the first engaging portion 802, a first connecting portion 803 extending from an opposite end of the first engaging portion 802, and a first pressing portion 804 extending from a distal end of the first connecting portion 803. The first contact portion 800 forms a first protrusion 800*a* at a front end thereof. The second contact 82 comprises a curved second engaging portion 822, a second bent portion 826 formed at an end of the second engaging portion 822, a second contact portion 820 extending from a distal end of the second bent portion 826, and a second pressing portion 824 extending from an opposite end of the second engaging portion 822. The second contact portion 820 forms a second protrusion 820*a* at a front end thereof. The ground contact 84 comprises a curved middle portion 842, an arcuate hook 840 extending from a top edge of an end of the middle portion 842, and a ground portion 844 extending from an opposite end of the middle portion 842. The third contact 86 comprises a curved third engaging portion 862, a third bent portion 866 formed at an end of the third engaging portion 862, a third contact portion 860 extending from a distal end of the third bent portion 866, a third connecting portion 863 extending from an opposite end of the third engaging portion 862, and a third pressing portion 864 extending from the third connecting portion 863. The third contact portion 860 forms a third protrusion 860*a* at a front end thereof. The fourth contact 88 comprises a curved fourth engaging portion 882, a fourth contact portion 880 extending from an end of the fourth engaging portion 882, and a fourth pressing portion 884 extending from an opposite end of the fourth engaging portion 882. The fourth contact portion 880 forms a fourth protrusion 880*a* at a front end thereof.

Figure 6:
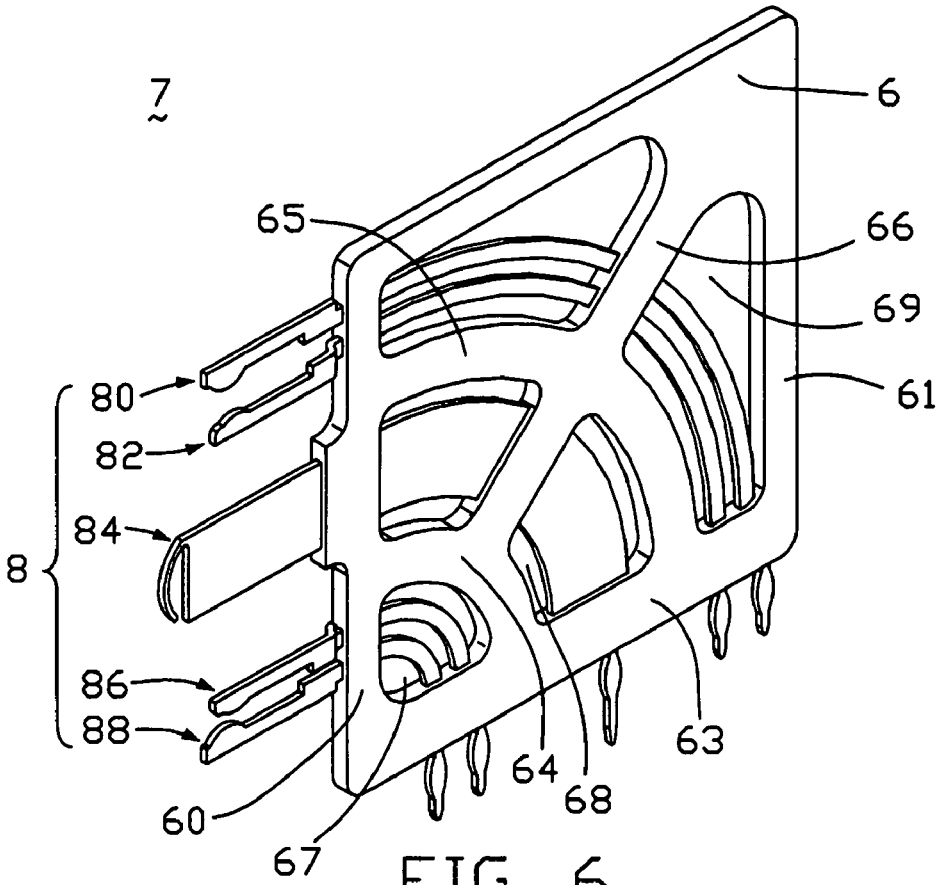
FIG. 6 is an isometric view of one of the contact modules of FIG. 1.

FIG. 6 is an isometric view of one of the contact modules 7. The first, second, third and fourth contacts 80, 82, 86, 88 and the ground contact 84 are insert-molded in the frame 6. The first contact 80 is disposed over the second contact 82. The first and second engaging portions 802, 822 of the first and second contacts 80, 82 cross through the front beam 60, the third rib 66 and the bottom beam 63, and are accordingly accommodated in the third spaces 69. The ground contact 84 is disposed below the second contact 82. The middle portion 842 of the ground contact 84 crosses through the front beam 60, the third rib 66 and the bottom beam 63, and is accordingly accommodated in the second space 68. The third contact 86 is disposed below the ground contact 84 and over the fourth contact 88. The third and fourth engaging portions 862, 882 of the third and fourth contacts 86, 88 cross through the front beam 60 and the bottom rib 63, and are accordingly accommodated in the first space 67.

Figure 7:
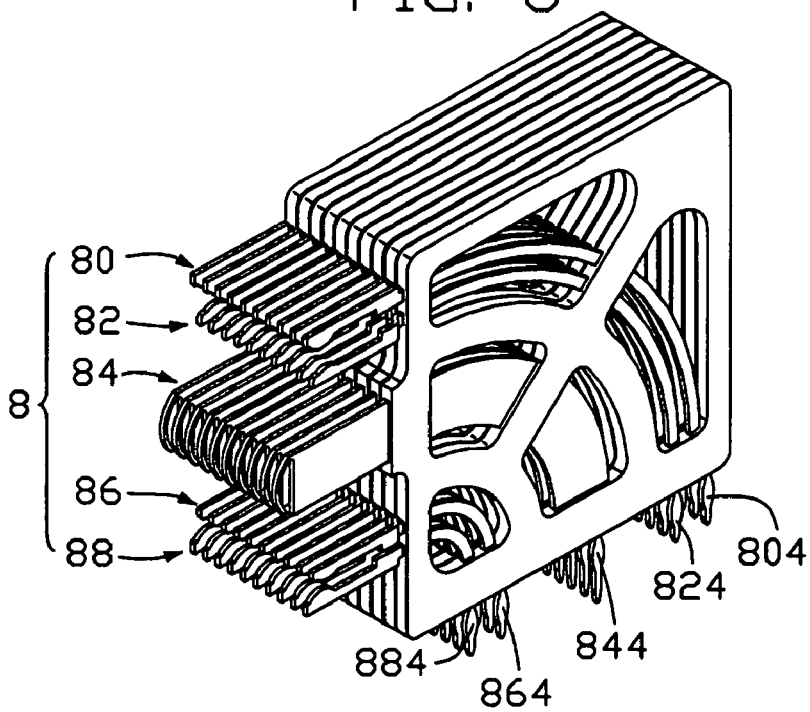
FIG. 7 is an isometric view of the contact modules of FIG. 1.

FIG. 7 is an isometric view of the ten contact modules 7 arrayed side by side together in a stack. The first and second contacts 80, 82 form a first signal contact group, with a row of the first contact portions 800 being above a row of the second contact portions 820. The rows of first and second contact portions 800, 820 are staggered relative to each other, as viewed from a front elevation. The third and fourth contacts 86, 88 form a second signal contact group, with a row of the third contact portions 860 being above a row of the fourth contact portions 880. The rows of third and fourth contact portions 860, 880 are staggered relative to each other, as viewed from the front elevation. The ground contacts 84 are located between the first signal contact group and the second signal contact group.

Figure 8:
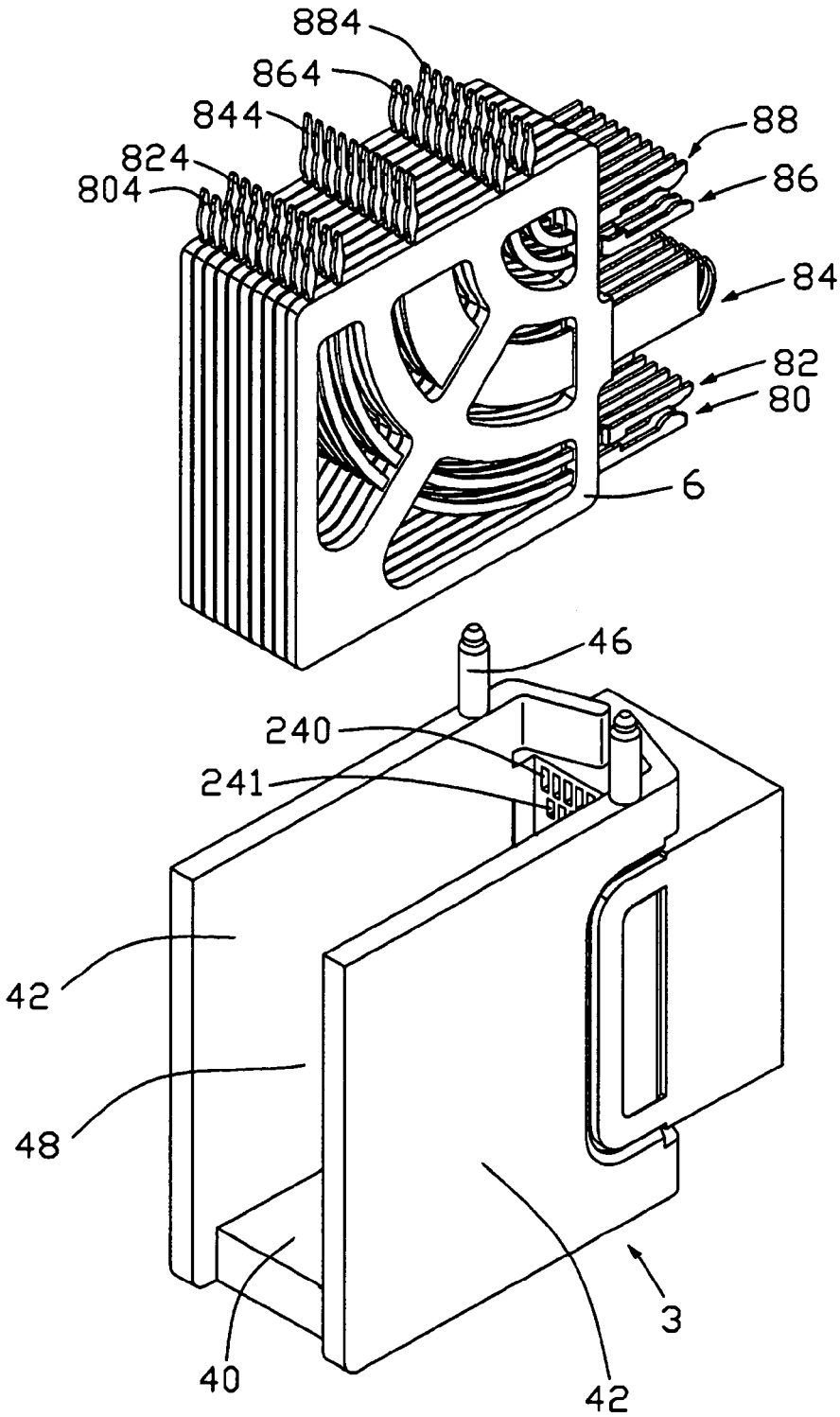
FIG. 8 is an exploded, isometric view of the connector of FIG. 1, but showing the connector inverted.
Figure 9:
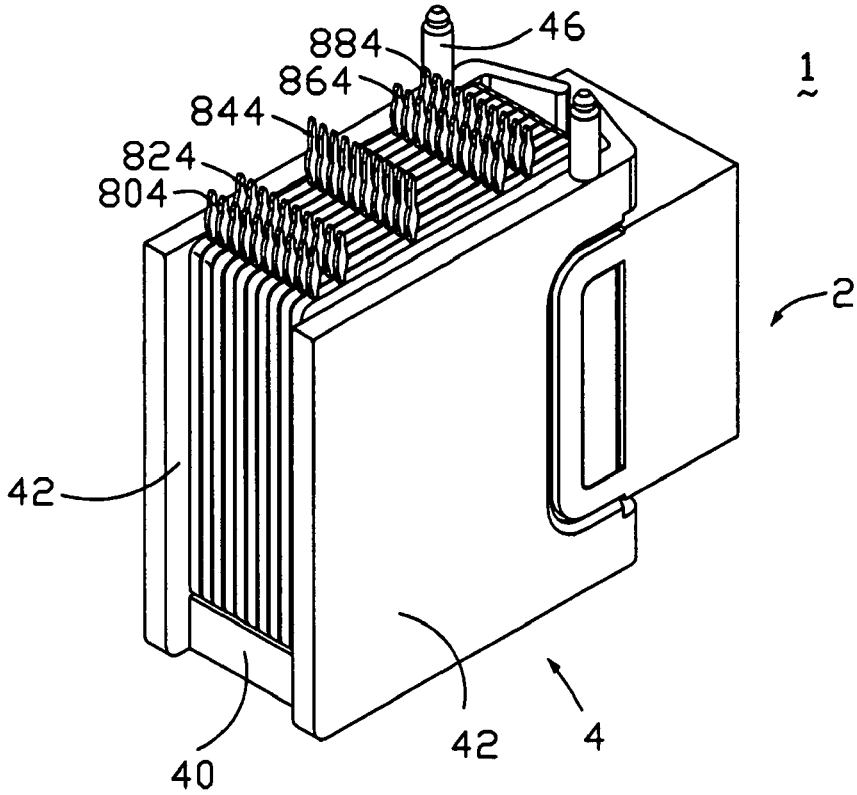
FIG. 9 is an assembled view of FIG. 8.
Figure 10:
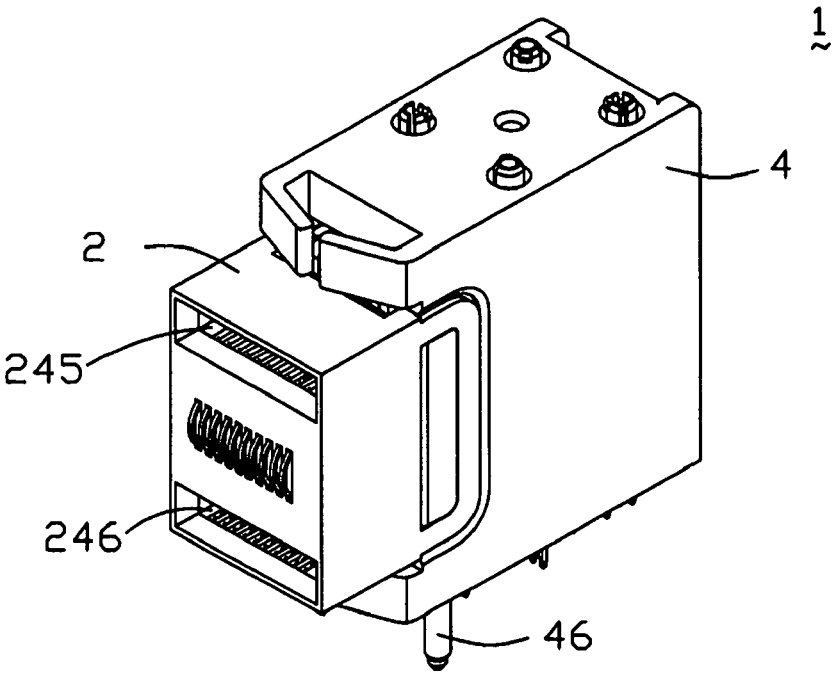
FIG. 10 is an assembled view of FIG. 1.
Figure 11:
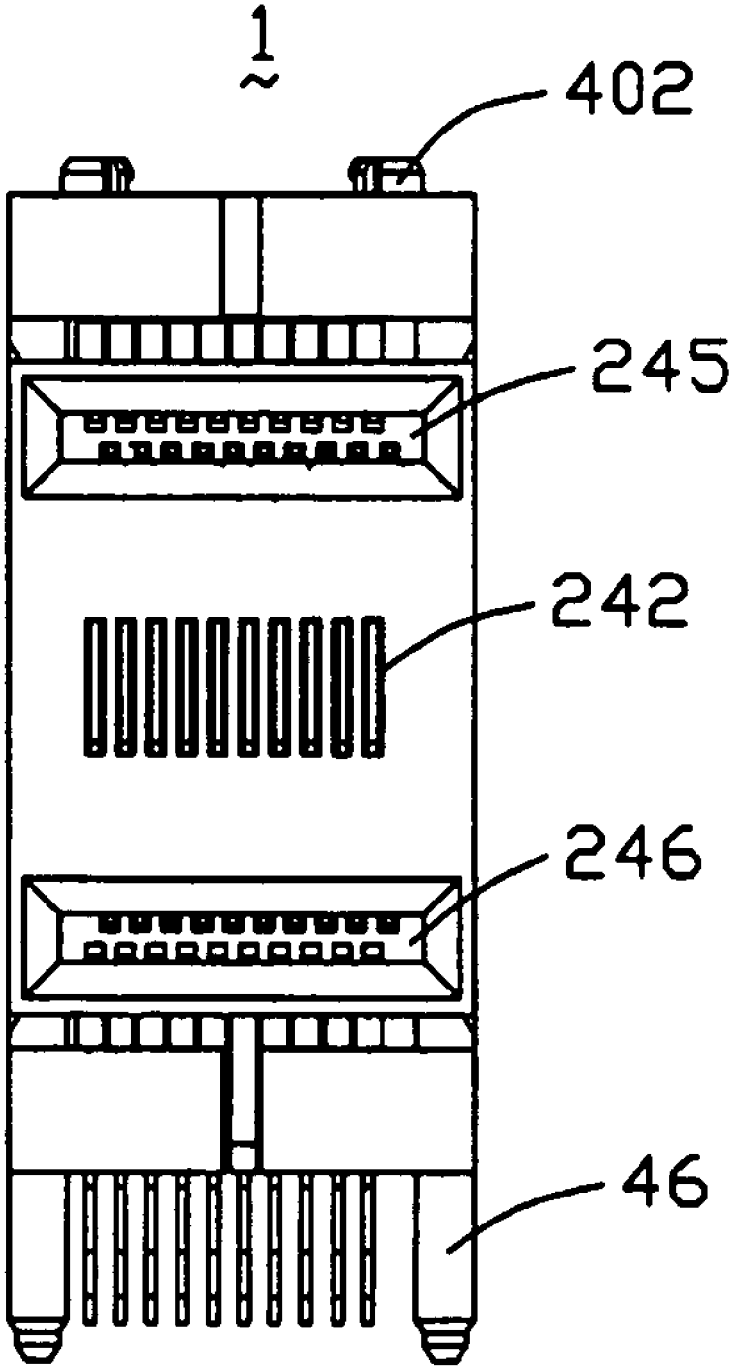
FIG. 11 is a front elevation of FIG. 10.

FIG. 8 is an exploded, isometric view of the connector 1 inverted. In assembly of the contact modules 7 into the housing 3, the housing 3 and the contact modules 7 are all inverted. Also referring to FIGS. 9 through 11, each contact module 7 is received in the receiving cavity 48 of the housing 3 from a rear side of the housing 3, with the first contact 80 inserted into a corresponding fifth passageway 244, the second contact 82 inserted into a corresponding fourth passageway 243, the ground contact 84 inserted into a corresponding third passageway 242, the third contact 86 inserted into a corresponding second passageway 241, and the fourth contact 88 inserted into a corresponding first passageay 240. The first and second contact portions 800, 820 of the first signal contact group are received in the first opening 245, for providing a first mating interface for a daughter board (not shown). The third and fourth portions 860, 880 of the second signal contact group are received in the second opening 246, for providing a second mating interface for another daughter board (not shown). The first and second pressing portions 804, 824, the ground portion 844 and the third and fourth pressing portions 864, 884 are exposed below a bottom of the housing 3. When the ten contact modules 7 are all inserted into the housing 3, the contact modules 7 are securely received in the housing 3 due to interferential friction among the housing 3 and the frames 6 of the contact modules 7.

The first and second pressing portions 804, 824, the ground portion 844 and the third and fourth pressing portions 864, 884 can be pressingly inserted through corresponding holes of the mother board, with the positioning posts 46 of the housing 3 being received through corresponding positioning holes of the mother board. The daughter boards are partly received in the first and second openings 245, 246 respectively. The connector 1 thereby electrically connects the daughter boards with the mother board.

In use, if one of the contact modules 7 is damaged, the connector 1 can be detached from the mother board. The damaged contact module 7 can then be removed from the housing 3 without damaging other contact modules 7 and the housing 3. A new contact module 7 can be inserted into the housing 3 to replace the damaged one, whereupon the connector 1 is reattached to the mother board. Thus, the cost of using and maintaining the connector 1 is reduced.

In the above-described embodiment, the connector 1 has two contact groups providing two mating interfaces for the daughter boards thereat. It should be understood that three or more contact groups can be disposed in the connector to providing three or more mating interfaces for daughter boards. For example, a third contact group may comprise a plurality of sixth and seventh contacts that have configurations similar to the third and fourth contacts 80, 82. By way of further example, a fourth contact group may comprise a plurality of eighth and ninth contacts that have configurations similar to the first and second contacts 86, 88. Ground contacts similar to the ground contacts 84 may be disposed between each two adjacent contact groups. The number of mating interfaces of the connector 1 can be configured according to the requirements of each particular application.

From the foregoing it will be recognized that the principles of the invention may be employed in various arrangements to obtain the features, advantages and benefits described above. It is to be understood, therefore, that even though numerous characteristics and advantages of the invention have been set forth together with details of the structure and function of the invention, this disclosure is to be considered as illustrative only. Various changes and modifications may be made in detail, especially in matters of size, shape and arrangements of parts, without departing from the spirit and scope of the invention as defined by the appended claims.

What is claimed is:

1. An electrical connector used in a transceiver that can provide bi-directional transmission of data for networking applications, comprising:

an insulative housing defining a row of first passageways, a row of second passageways, a row of third passageways, a row of fourth passageways and a row of fifth passageways therethrough, a first opening in a top of a front portion thereof communicating with the fourth and fifth passageways, and a second opening in a bottom of the front portion thereof communicating with the first and second passageways;

a first signal contact group including a plurality of first contacts received in the fifth passageways and a plurality of second contacts received in the fourth passageways, the first and second contacts having first and second contact portions received in the first opening of the housing to provide a first mating interface for an electronic component;

a second signal contact group including a plurality of third contacts received in the second passageways and a plurality of fourth contacts received in the first passageways, the third and fourth contacts having third and fourth contact portions received in the second opening of the housing to provide a second mating interface for another electronic component; and a plurality of ground contacts received in the third passageways and between the first and second signal contact groups.

2. The electrical connector as claimed in claim 1, wherein the housing defines two holes in each of opposite lateral side portions of a top portion thereof, and a bifurcated post protruding out of the top portion thereof in each hole.

3. The electrical connector as claimed in claim 1, wherein the rows of first and second passageways are staggered relative to each other.

4. The electrical connector as claimed in claim 1, wherein the rows of fourth and fifth passageways are staggered relative to each other.

5. An electrical connector comprising:

an insulative housing defining a generally rectangular cavity in a rear portion thereof; and a plurality of contact modules received in the cavity of the housing, each contact module comprising:

an insulative frame;

a first contact insert-molded in the frame;

a second contact insert-molded in the frame below the first contact;

a ground contact insert-molded in the frame below the second contact;

a third contact insert-molded in the frame below the ground contact; and a fourth contact insert-molded in the frame below the third contact; wherein the housing includes a base portion and a head portion mounted onto a front portion of the base portion; wherein the base portion comprises a pair of lateral walls and a top wall interconnecting top ends of the lateral walls thereby the lateral walls and the top wall defining the cavity therebetween; wherein each lateral wall defines a recess at a front middle portion thereof and a wedge in the recess; wherein the head portion comprises a body and a pair of eats extending from opposite sides of the body; wherein each ear defines a generally rectangular window, a corresponding wedge of the base portion engaging in the window to securely mount the head portion onto the base portion.

6. The electrical connector as claimed in claim 5, wherein the head portion defines a row of first passageways, a row of second passageways, a row of third passageways, a row of fourth passageways and a row of fifth passageways therethrough for receiving the first, second, third and fourth contacts and the ground contacts therein respectively.

7. The electrical connector as claimed in claim 6, wherein the rows of first and second passageways are staggered relative to each other, and the rows of fourth and fifth passageways are staggered relative to each other.

8. The electrical connector as claimed in claim 5, each first contact comprises a curved engaging portion, a contact portion extending from an end of the engaging portion, a connecting portion extending from an opposite end of the engaging portion, and a pressing portion extending from a distal end of the connecting portion.

9. The electrical connector as claimed in claim 5, wherein each second contact comprises a curved engaging portion, a bent portion formed at an end of the engaging portion, a contact portion extending from a distal end of the bent portion, and a pressing portion extending from an opposite end of the engaging portion.

10. The electrical connector as claimed in claim 5, wherein each ground contact comprises a curved middle portion, an arcuate hook extending from a top edge of an end of the middle portion, and a ground portion extending from an opposite end of the middle portion.

11. The electrical connector as claimed in claim 5, wherein each third contact comprises a curved engaging portion, a bent portion formed at an end of the engaging portion, a contact portion extending from a distal end of the bent portion, a connecting portion extending from an opposite end of the engaging portion, and a pressing portion extending from a distal end of the connecting portion.

12. The electrical connector as claimed in claim 5, wherein the fourth contact comprises a curved engaging portion, a contact portion extending from an end of the engaging portion.

13. An electrical connector assembly comprising:

an insulative housing defining a generally rectangular cavity in a rear portion thereof; and a plurality of contact modules received in the cavity of the housing, each contact module comprising;

an insulative frame;

a first contact insert-molded in the frame;

a second contact insert-molded in the frame below the first contact;

a ground contact insert-molded in the frame below the second contact;

a third contact insert-molded in the frame below the ground contact;

a fourth contact insert-molded in the frame below the third contact; and said ground contact defining a resilient portion in confrontation with a mated connector for exerting an urging force against said mated connector along an un-mating direction opposite to a mating direction; wherein said housing forms a resilient portion for exerting another urging force against the mated connector along said un-mating direction.

* * * * *